US009986887B2

(12) United States Patent
Anim-Mensah et al.

(10) Patent No.: US 9,986,887 B2
(45) Date of Patent: Jun. 5, 2018

(54) WAREWASHER WITH DRAIN WATER TEMPERING SYSTEM WITH ENERGY RECOVERY

(71) Applicants: Alexander R. Anim-Mensah, Centerville, OH (US); Bryan J. Waechter, Dayton, OH (US)

(72) Inventors: Alexander R. Anim-Mensah, Centerville, OH (US); Bryan J. Waechter, Dayton, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 489 days.

(21) Appl. No.: 14/680,102

(22) Filed: Apr. 7, 2015

(65) Prior Publication Data

US 2015/0320288 A1 Nov. 12, 2015

Related U.S. Application Data

(60) Provisional application No. 61/990,996, filed on May 9, 2014.

(51) Int. Cl.
*A47L 15/42* (2006.01)
*A47L 15/24* (2006.01)

(52) U.S. Cl.
CPC ..... *A47L 15/4291* (2013.01); *A47L 15/241* (2013.01); *A47L 15/4219* (2013.01); *A47L 15/4285* (2013.01); *A47L 15/247* (2013.01)

(58) Field of Classification Search
CPC ..... A47L 15/4291
See application file for complete search history.

(56) References Cited

U.S. PATENT DOCUMENTS 3,946,802 A 3/1976 Christenson
4,219,044 A 8/1980 Wilson
(Continued)

FOREIGN PATENT DOCUMENTS

DE 2447428 4/1975
DE 9410453 12/1994
(Continued)

OTHER PUBLICATIONS

PCT, International Search Report and Written Opinion, International Application No. PCT/US2015/029030, dated Jul. 13, 2015, 12 pages.

*Primary Examiner* — Mikhail Kornakov
*Assistant Examiner* — Ryan L. Coleman
(74) *Attorney, Agent, or Firm* — Thompson Hine LLP

(57) ABSTRACT

A warewash machine includes a sump for collecting hot cleaning water that is recirculated in the chamber during cleaning, a drain path for draining cleaning water from the sump and a fresh water input line including at least a fresh water input that receives fresh water. A waste water heat recovery arrangement includes a plurality of heat exchange compartments arranged in series flow communication and forming part of the drain path. A waste water input is associated with a first of the heat exchange compartments and a waste water output associated with a last of the heat exchange compartments. Waste water at least partially fills each of the heat exchange compartments. At least part of the fresh water input line passes through each of the heat exchange compartments. Heat from waste water is transferred to fresh water in the drain line within each heat exchange compartment.

9 Claims, 4 Drawing Sheets

(56) References Cited

U.S. PATENT DOCUMENTS

| | | | | |
|---|---|---|---|---|
| 4,326,551 | A | 4/1982 | Voorhees | |
| 4,529,032 | A | 7/1985 | Molitor | |
| 4,550,771 | A * | 11/1985 | Arbabian | F24D 11/005 126/643 |
| 5,137,043 | A * | 8/1992 | Wickham, III | B08B 9/0826 134/167 R |
| 5,660,193 | A | 8/1997 | Archer et al. | |
| 5,816,273 | A | 10/1998 | Milocco et al. | |
| 5,829,459 | A | 11/1998 | Milocco et al. | |
| 6,591,846 | B1 | 7/2003 | Ferguson et al. | |
| 8,146,612 | B2 | 4/2012 | Brunswick et al. | |
| 2007/0143914 | A1 | 6/2007 | Shirai et al. | |
| 2009/0250085 | A1* | 10/2009 | Gaus | A47L 15/241 134/56 D |
| 2009/0277482 | A1* | 11/2009 | Kim | A47L 15/4285 134/105 |
| 2010/0024844 | A1 | 2/2010 | Brunswick et al. | |
| 2011/0203303 | A1* | 8/2011 | Moure | F24D 11/025 62/324.1 |

FOREIGN PATENT DOCUMENTS

| | | |
|---|---|---|
| KR | 20080058129 | 6/2008 |
| WO | WO 2011/091940 | 8/2011 |

* cited by examiner

| FRESH INCOMING WATER RATE (gpm) | HOT WASTE WATER TEMPERATURE (F) | FRESH INCOMING COLD WATER TEMPERATURE (F) | TEMPERED WASTE WATER TEMPERATURE OUT (F) | PREHEATED FRESH WATER TEMPERATURE OUT (F) | COMPARTMENT TEMPERATURES (F) | | | kW EXTRACTED BY FRESH WATER | kW EXTRACTED PER SURFACE AREA (kW/m²) |
|---|---|---|---|---|---|---|---|---|---|
| | | | | | 70A | 70B | 70C | | |
| 0.75 | 127 | 63 | 84 | 96 | 109 | 96 | 84 | 3.65 | 5.00 |
| 0.93 | 133 | 63 | 88 | 100 | 111 | 100 | 88 | 5.07 | 6.95 |
| 1.35 | 129 | 63 | 83 | 87 | 106 | 93 | 83 | 4.77 | 6.53 |

WAREWASHER WITH DRAIN WATER TEMPERING SYSTEM WITH ENERGY RECOVERY

TECHNICAL FIELD

This application relates generally to warewashers and, more particularly, to a warewasher with a drain water tempering system.

BACKGROUND

In some commercial warewash machines, drain water is at a temperature above that permitted by plumbing codes for draining. This undesired result is due to the fact that cleaning water and rinse water used for cleaning and rinsing in commercial machines are both typically well above the applicable limit temperature. In order to cool the drain water, fresh cold water is sometimes flushed down the drain with the drain water to lower water temperature. A tempering kit is used for this purpose, which allows fresh water to mix with the waste/drain water to bring overall temperature down to the acceptable level before being discharged to the drain. In the operation of these warewash machines, the amount of waste water exiting the machine must also be replenished for by the same amount of incoming replacement fresh water, which must be heated for use in the machine.

Energy efficiency continues to be a significant issue in the field of warewash machines, particularly commercial warewash machines that tend to be high volume machines. It is known to provide heat recovery systems for recovering some heat from drain/waste water that is being purged from the machine as exemplified by U.S. Pat. No. 5,660,193. U.S. Pat. No. 8,146,612 discloses a system in which heat from the drain water is recovered utilizing a counterflow serpentine pipe arrangement.

Nonetheless, it would be desirable to provide a warewash machine with a new and advantageous waste water energy recovery system.

SUMMARY

In one aspect, a warewash machine includes a housing at least in part defining a chamber for cleaning wares, a sump for collecting hot cleaning water that is recirculated in the chamber during cleaning, a drain path for draining cleaning water from the sump and a fresh water input line including at least a fresh water input that receives fresh water. A waste water heat recovery arrangement includes a plurality of heat exchange compartments arranged in series flow communication and forming part of the drain path, a waste water input associated with a first of the heat exchange compartments and a waste water output associated with a last of the heat exchange compartments, such that waste water at least partially fills each of the heat exchange compartments. At least part of the fresh water input line passes through each of the heat exchange compartments, such that heat from waste water in each of the heat exchange compartments is transferred to fresh water in a portion of the fresh water input line within each heat exchange compartment.

In one implementation, adjacent heat exchange compartments are separated from each other by a baffle arrangement including a baffle over which waste water must travel to progress from one heat exchange compartment to a next heat exchange compartment.

In one implementation, the portion of the fresh water input line in each heat exchange compartment comprises a coil in each heat exchange compartment, the coil is submerged in the heat exchange compartment when waste water within each compartment reaches a normal operating level. The coils may be interconnected in series.

In one implementation, the coils are arranged such that a first coil along the fresh water input line is located in the last heat exchange compartment, and a last coil along the fresh water input line is located in the first heat exchange compartment.

In one implementation, each heat exchange compartment includes a drain outlet.

In one implementation, the drain outlets of the heat exchange compartments flow to a common compartment cleaning drain line with an associated valve to control flow or no flow along the common compartment cleaning drain line.

In one implementation, the heat exchange compartments are arranged as a module with a common lid covering the heat exchange compartments, the common lid movable between closed and open positions, wherein when the valve is in the flow condition and the lid is in the open position, water can be sprayed into the compartments for cleaning the compartments and the cleaning water travels through the drain outlets and along the common compartment cleaning drain line.

In one implementation, the heat exchange compartments are located such that head pressure of waste water in the sump drives flow through the compartments.

In one implementation, the heat exchange compartments and waste water flow paths between the heat exchange compartments are sized to prevent clogging from any debris in the waste water, and the drain path lacks any filter.

In one implementation, the heat exchange compartments are located within a footprint of the warewash machine.

In one implementation, the plurality of heat exchange compartments consist of three heat exchange compartments.

In one implementation, flow adjacent heat exchange compartments are separated by baffle arrangements, the baffle arrangement configured to promote turbulence of waste water flowing through the heat exchange compartments so as to improve heat exchange.

In one implementation, the machine includes a rinse system including a booster heater, wherein the fresh water input line is operatively connected to deliver fresh water to the booster heater after the fresh water has passed through the waste water heat recovery system.

In another aspect, a method of recovering energy from waste water being delivered out of a warewash machine involves: delivering the waste water along a drain path that includes a plurality of heat exchange compartments; and delivering fresh water along a fresh water input line that passes through each of the heat exchange compartments such that heat from the waste water is passed to the fresh water in the fresh water input line.

In one implementation, adjacent heat exchange compartments are separated from each other by a baffle arrangement including a baffle over which waste water must travel to progress from one heat exchange compartment to a next heat exchange compartment.

In one implementation, the portion of the fresh water input line in each heat exchange compartment comprises a coil in each heat exchange compartment, the coil submerged in the heat exchange compartment when waste water within each compartment reaches a normal operating level.

In one implementation, the coils are arranged such that a first coil along the fresh water input path is located in the last heat exchange compartment, and a last coil along the fresh water input path is located in the first heat exchange compartment.

In one implementation, each heat exchange compartment includes a drain outlet, and the heat exchange compartments are arranged as a module with a common lid covering the heat exchange compartments, the common lid movable between closed and open positions for accessing the heat exchange compartments for cleaning.

In one implementation, the heat exchange compartments are arranged to define distinct heat exchange zones, and the average temperature in each heat exchange zone is at least 5° F. less than the average temperature in the immediately upstream heat exchange zone.

In a further aspect, a waste water heat recovery arrangement for use in recovering energy from waste water being expelled from a warewasher to a drain includes a plurality of heat exchange compartments arranged in series flow communication to form a compartmentalized drain path, a waste water input associated with a first of the heat exchange compartments and a waste water output associated with a last of the heat exchange compartments. A fresh water input line passes through each of the heat exchange compartments, a portion of the fresh water input line in each heat exchange compartment comprises a coil in the heat exchange compartment.

The details of one or more embodiments are set forth in the accompanying drawings and the description below. Other features, objects, and advantages will be apparent from the description and drawings, and from the claims.

DETAILED DESCRIPTION

Figure 1:
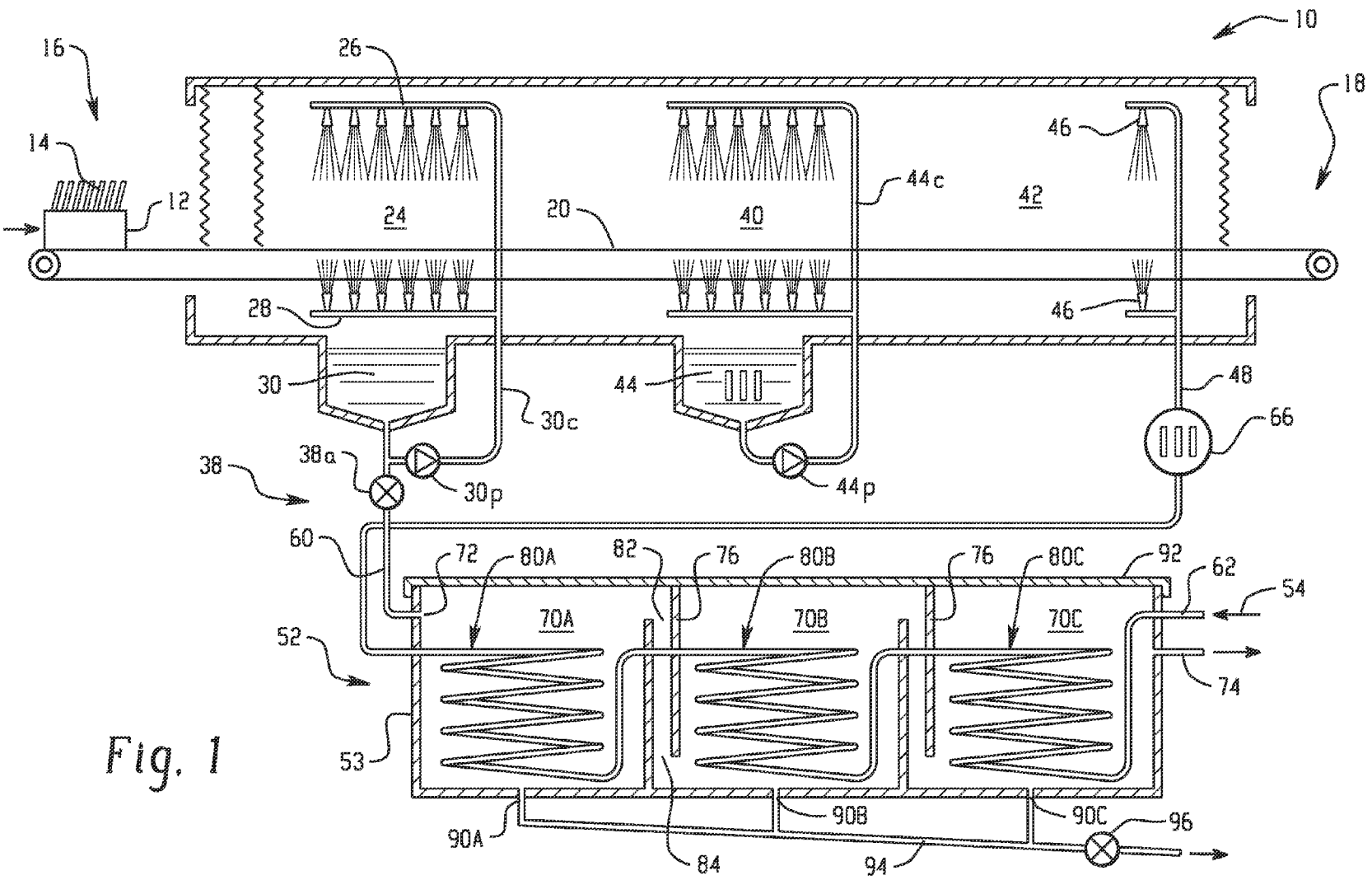
FIG. 1 is a schematic depiction of a warewash system.

Referring to FIG. 1, an exemplary conveyor-type warewash system, generally designated 10, is shown. Warewash system 10 can receive racks 12 of soiled wares 14 from an input side 16 which are moved through a tunnel-like chamber from the input side toward an output side 18 at an opposite end of the warewash system by a suitable conveyor mechanism 20. Either continuously or intermittently moving conveyor mechanisms or combinations thereof may be used, depending, for example, on the style, model and size of the warewash system 10. The racks 12 of soiled wares 14 enter the warewash system 10 (e.g., through a flexible curtain) into a wash chamber or zone 24 where sprays of liquid from upper and lower wash manifolds 26 and 28 above and below the racks, respectively, function to flush heavier soil from the wares. The liquid for this purpose is recirculated from a tank 30 via a pump 30*p* and supply conduit 30*c*. The tank 30 acts as a sump that captures the water after spraying so that it can be recirculated. A heater, such as an electrical immersion heater provided with suitable thermostatic controls (not shown), may be used to maintain the temperature of the cleansing liquid in the tank 30 at a suitable level (e.g., 160 degrees F. or more). A drain system 38 (e.g., including drain valve 38*a*) provides a flow path by which liquid is drained from the tank 30.

The wash zone 24 may be a pre-wash zone, with a main wash zone 40 located downstream and a rinse zone 42 located further downstream. Separate tanks (e.g., tank 44 with recirculating flow via pump 44*p* and supply conduit 44*c*) may also be provided for the downstream wash zone(s). The final rinse zone 42 may be provided with upper and lower spray heads 46 that are supplied with a flow of fresh hot water via a conduit or pipe 48.

The warewash system 10 includes a drain water heat recovery system 52 that utilizes waste water (e.g. traveling from tank 30 along drain line 60) to heat incoming cold water (e.g., traveling along fresh water input line 62) from a fresh water source (represented by arrow 54) thereby reducing temperature of the waste water. The heated fresh water may be delivered into a booster heater 66 for further heating before being utilized for rinsing.

In the illustrated embodiment, the system 52 includes a module 53 with three heat exchange compartments 70A-70C connected in series. It is noted that FIG. 1 is schematic only, and that typically the relative size of the recovery system module 53 would be smaller than that shown as compared to the size of machine cleaning zones. The waste water enters compartment 70A through an input 72, and will progress through the compartments to reach output 74. Baffle arrangements 76 are located between adjacent compartments. The fresh water line 62 enters compartment 70C and then progresses to compartments 70B and 70A in sequence, with the line being formed to include a coil 80A, 80B, 80C located in each compartment to enhance surface area for heat exchange. Each coil is submerged in the heat exchange compartment when waste water within each compartment reaches its normal operating level. Notably, the coils are arranged such that a first coil along the fresh water input line is located in the last heat exchange compartment, and a last coil along the fresh water input line is located in the first heat exchange compartment. The fresh water line exits compartment 70A and delivers the preheated fresh water to the booster heater 66.

As noted, each heat exchange compartment is separated from any upstream adjacent heat exchange compartment or downstream adjacent heat exchange compartment by a baffle arrangement 76. The illustrated baffle arrangement provides an upper outlet 82 from the upstream heat exchange compartment and a lower inlet 84 to the downstream heat exchange compartment. In addition, the baffle arrangements promote turbulence of waste water flowing through the heat exchange compartments so as to improve heat exchange.

As seen in FIG. 1, each heat exchange compartment includes a drain outlet 90A, 90B, 90C. The heat exchange compartments may be arranged as a module with a common lid 92 covering the heat exchange compartments, the common lid movable between closed and open positions. The drain outlets of each of the heat exchange compartments flow to a common compartment cleaning drain line 94 with an associated valve 96 to control flow or no flow along the common compartment cleaning drain line 94. When the valve 96 is in the open flow condition and the lid 92 is in the open position, water can be sprayed into the compartments for cleaning the compartments and the cleaning water travels through the drain outlets 90A, 90B, 90C and along the common compartment cleaning drain line 94. The compartment drain line 94 is for as needed cleaning of the compartments and eliminates the need for a filter that would need to be replaced regularly. During the process of cleaning the compartments, the operator opens the lid 92 and hoses down the unit with the valve 96 opened automatically or manually.

The heat exchange compartments and waste water flow paths between the heat exchange compartments (e.g., through the baffles 76), as well as the drain outlets of each compartment, may be sized to prevent clogging from any debris in the waste water, so that the drain path can be implemented without including a filter. Generally, the heat exchange compartments may be located such that head pressure of waste water in the tank 30 drives flow through the compartments (e.g., lower than the sump/tank of the machine). The heat exchange module 53 may be located within a footprint of the warewash machine, or alongside the machine. This system provides cascading of the waste water from one compartment to the other (70A, then 70B, then 70C) to be tempered while preheating the incoming water in the coils 80A, 80B, 80C in a counterflow arrangement (e.g., the incoming water is heated in coil 80C, then coil 80B, then coil 80A).

Figure 2:
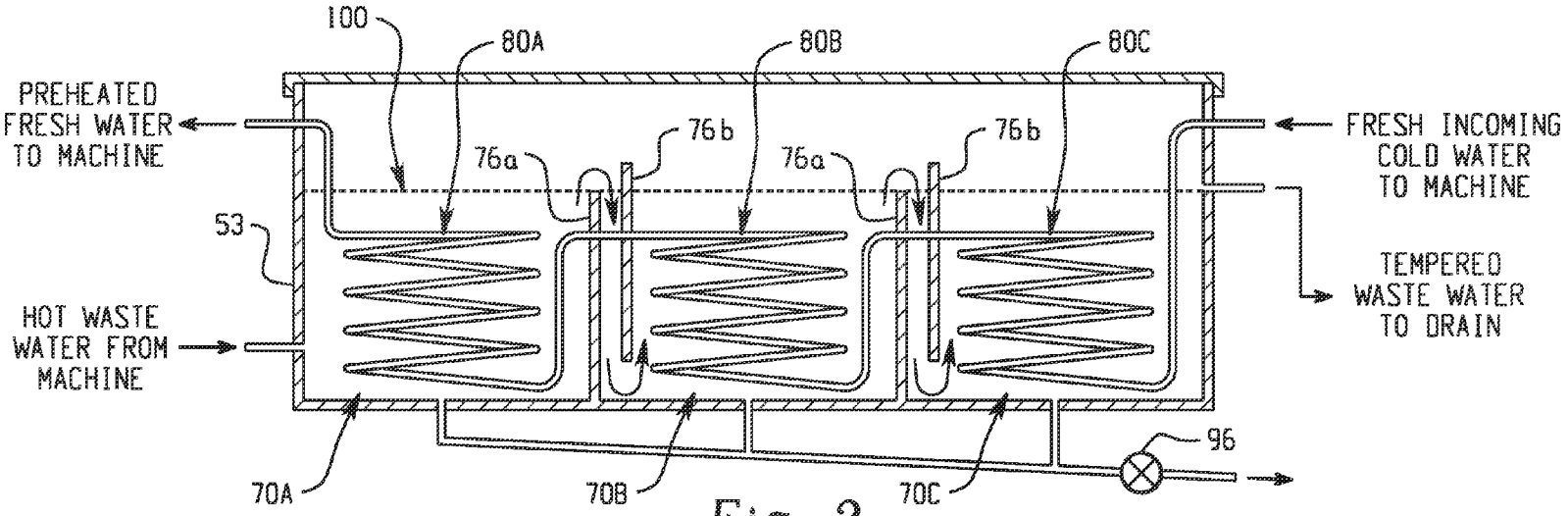
FIG. 2 is a schematic side-elevation of one embodiment of a heat exchange module.
Figure 3:
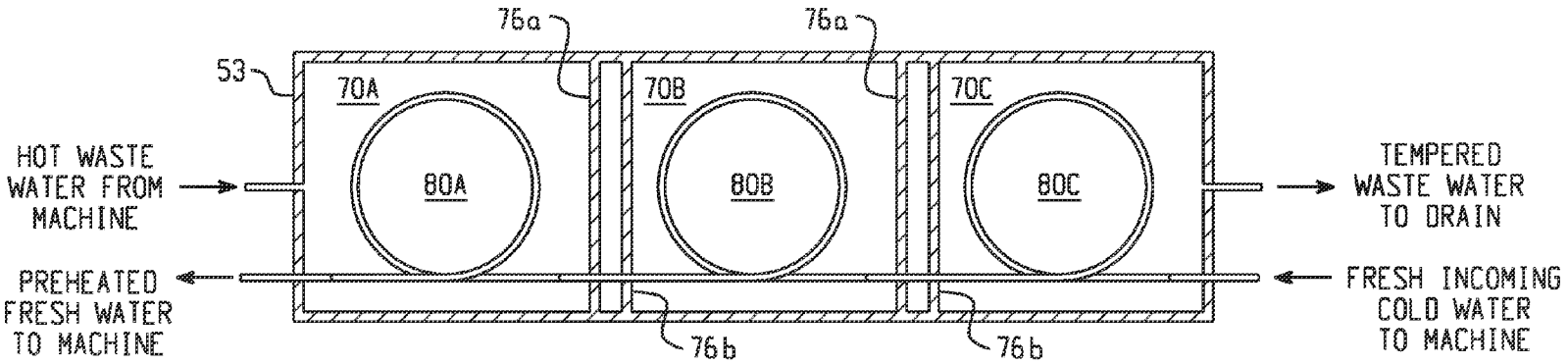
FIG. 3 is a schematic top plan view of the heat exchange module of FIG. 2.

The flow through the heat exchange module 53 is shown schematically in FIGS. 2 and 3. Two baffle walls 76*a*, 76*b* make up each baffle arrangement between the compartments. Waste water flowing from one compartment to the next flows over baffle 76*a* and under baffle 76*b*, and the operating water level 100 within the module 53 is consistent throughout the multiple compartments.

Figure 4:
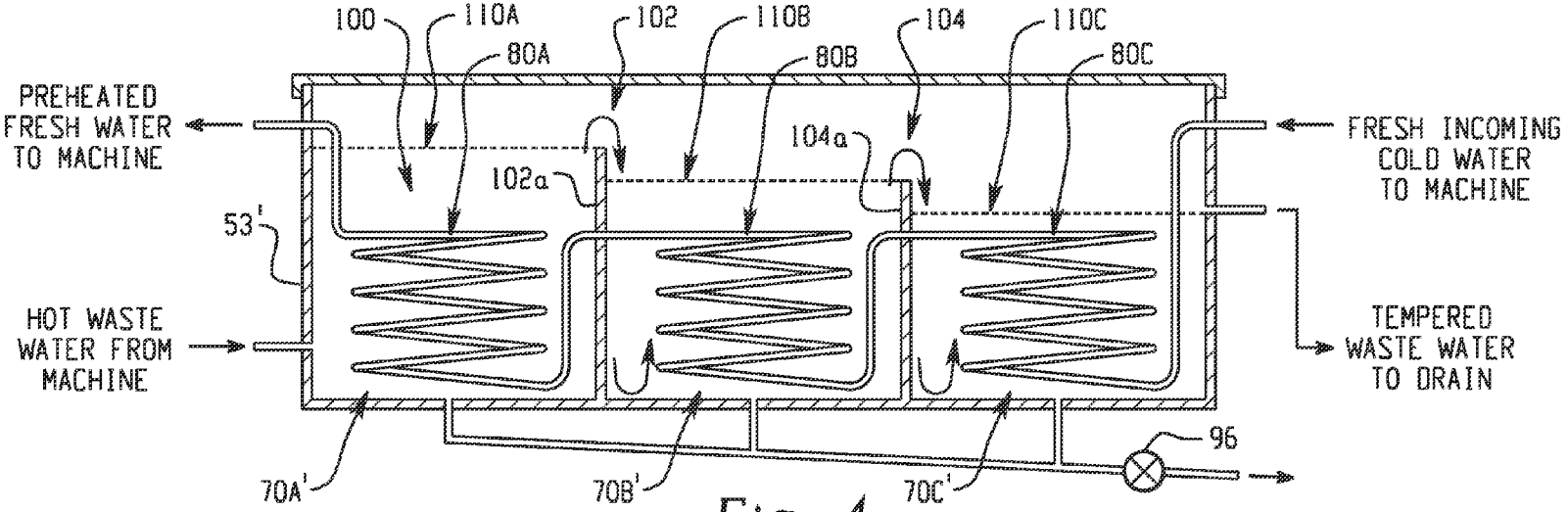
FIG. 4 is a schematic side-elevation of another embodiment of a heat exchange module.
Figure 5:
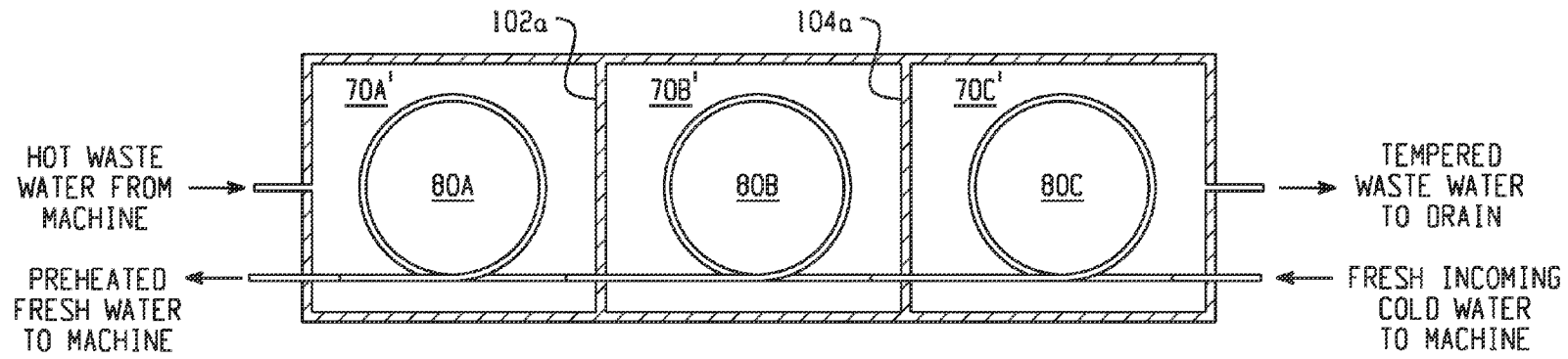
FIG. 5 is a schematic top plan view of the heat exchange module of FIG. 4.

In an alternative embodiment shown in FIGS. 4 and 5, a heat exchange module 53' includes baffle arrangement 102 between compartments 70A' and 70B' and a baffle arrangement 104 between compartment 70B' and 70C'. Each baffle arrangement is formed by a respective single baffle wall 102*a*, 104*a*, over which waste water must flow to reach the next compartment. Notably, baffle wall 102*a* is higher than baffle wall 104*a*, and the outlet 74 is located lower than the top edge of both baffle walls. This configuration results in an arrangement in which the compartment water level varies. In particular, water level 110A in compartment 70A', is higher than water level 110B in compartment 70B', and water level 110B is higher than water level 110C in compartment 70C'.

Both illustrated cascade module embodiments includes a circular coil configuration, three compartments of rectangular shape and baffles between compartments are shown. However, other coil configurations, less than three or more than three compartments, differently shaped compartments and/or compartment flow controls other than baffles could be used. Embodiments with more than one coil in each compartment could be implemented, and the heat exchange surface could be single or double-walled (e.g., a double-walled tube to form the heat exchange coils). In addition, incoming fresh water transferred under municipal pressure and wastewater drained by gravity of hydrostatic pressure are contemplated by the illustrated embodiments. However, the concept may apply to situations with pumps and where other fluids are involved. Moreover, although a conveyor-type machine is shown in FIG. 1, the tempering arrangement could be implemented on other machines. Warewash machines are categorized into two types based on the operating modes (i.e., batch or continuous) and this concept is applicable to both machine types. Moreover, the concept applies for concurrent and mixed flow systems.

Basic equations used to calculate the surface area, extent of turbulence and retention time are as in Equations (1), (2) and (3). The surface area of the heat transfer between the hot wastewater and fresh water is calculated using Equation (1):

$$(V\rho Cp\Delta T)_{wastewater}=(UA\Delta TLm)_{freshwater\ coil} \tag{1}$$

Where V, ρ, $C_p$ and ΔT are the wastewater volumetric flow rate, density, specific heat capacity and expected drop in temp of the wastewater. U, A and ΔTLm are overall heat transfer coefficient, surface area of connecting coil and log mean temperature as function of the drain water and fresh water temperatures before and after heat transfer. The extent of turbulence of the wastewater in each compartment is calculated using the Reynolds number (NRe) as in Equation (2) below:

$$NRe = 0.637\frac{V\rho}{\mu}\left(\frac{a+b}{ab}\right) \tag{2}$$

Where "a" and "b" are the baffle channel spacing and μ is viscosity of water. The retention time (t) in each compartment with v volume of wastewater is calculated using Equation (3):

$$t = \frac{v}{V}. \tag{3}$$

Figures 6, 7:
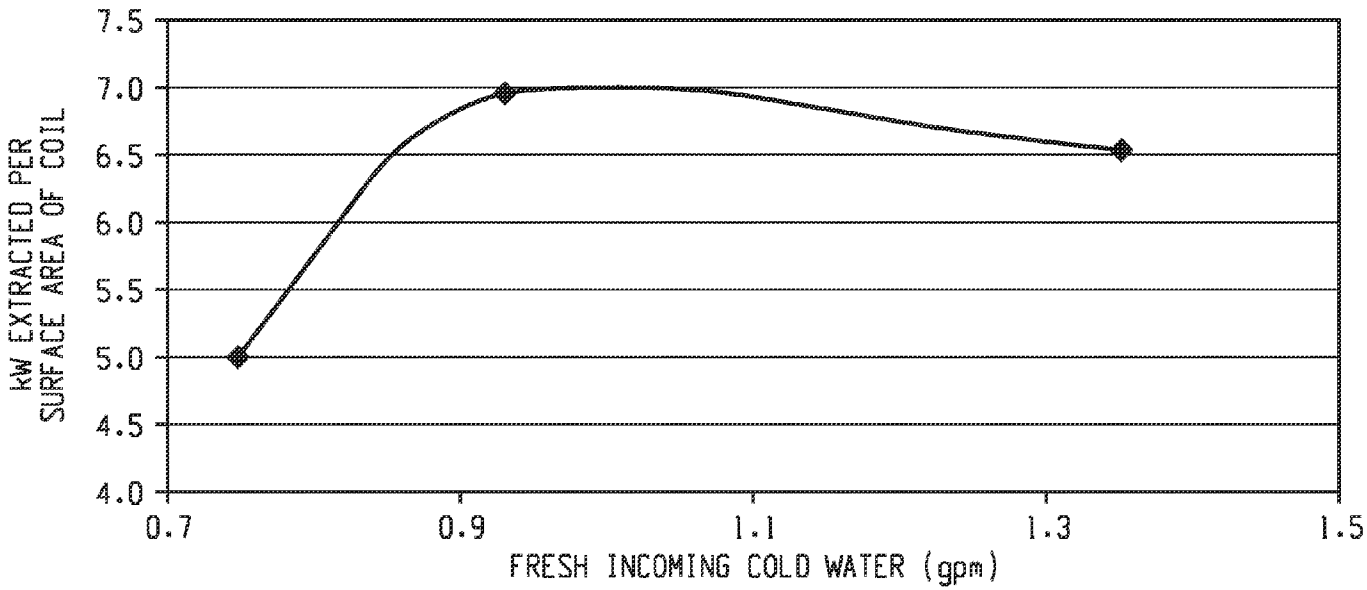
FIG. 6 is a table showing exemplary test results.
FIG. 7 is a graph depicting exemplary heat extraction vs. fresh water flow per the test results of FIG. 6.

The table of FIG. 6 shows exemplary temperatures taken at a fresh water rate of 0.75, 09.3 and 1.35 gpm (gallons per minute) at an intermittent waste or drain water rate of 1.0 gpm. The coil surface area used for testing the concept is 7.86 $ft^2$ (0.73 $m^2$). The compartment temperatures were taken at the center of each compartment in a module of type 53. FIG. 7 shows a graph 120 depicting the kW extracted according to the above examples.

The described system may provide advantages such as: retention of the waste water (e.g., in the compartments) to allow for effective heat recovery and tempering, baffles placed to promote sufficient turbulence for efficient heat transfer, effective energy recovered per surface area of coil, effective tempering per surface area of compartment and the coil, compactness of the whole system, easy cleaning of waste deposits from the compartments, the ability to eliminate any filter for the wastewater, no need for a pump on either the drain or fresh water side, saving water while recovering energy, ability to use a smaller booster and/or tempering waste water far below acceptable per the International Mechanical Code (IMC) and Uniform Plumbing Code (UPC) standard (e.g., below 140 F).

The system may be sized and operated to assure that sufficient tempering occurs both during normal waste water flows, where some waste water flows out of the machine during and/or after each cleaning cycle and during shut down flows where all water is drained from the machine (e.g., which may involve assuring sufficient baffle height to accommodate full drain down and/or utilizing a higher flow rate of the incoming fresh water to achieve desired tempering).

The heat exchange compartments may arranged to define distinct heat exchange zones as shown, and the average temperature in each heat exchange zone may be at least 5° F. less (e.g., at least 8° F. less) than the average temperature in the immediately upstream heat exchange zone.

It is to be clearly understood that the above description is intended by way of illustration and example only and is not intended to be taken by way of limitation, and that changes and modifications are possible. Accordingly, other embodiments are contemplated and modifications and changes could be made without departing from the scope of this application. For example, the configuration of the conveyor warewasher (e.g., number of zones and source of the waste water) could vary. Moreover, the waste heat recovery arrangement could be incorporated into batch-type dishwashers as well.

What is claimed is:

1. A warewash machine, comprising:

a housing at least in part defining a chamber for cleaning wares;

a sump for collecting hot cleaning water that is recirculated in the chamber during cleaning;

a drain path for draining cleaning water from the sump;

a fresh water input line including at least a fresh water input that receives fresh water;

a waste water heat recovery arrangement including:

a plurality of heat exchange compartments arranged in series flow communication and forming part of the drain path, a waste water input associated with a first of the heat exchange compartments and a waste water output associated with a last of the heat exchange compartments, such that waste water at least partially fills each of the heat exchange compartments;

at least part of the fresh water input line passing through each of the heat exchange compartments, such that heat from waste water in each of the heat exchange compartments is transferred to fresh water in a portion of the fresh water input line within each heat exchange compartment;

wherein adjacent heat exchange compartments are separated from each other by a baffle arrangement including a baffle over which waste water must travel to progress from one heat exchange compartment to a next heat exchange compartment;

wherein the portion of the fresh water input line within each heat exchange compartment comprises a coil in each heat exchange compartment, each coil submerged in its respective heat exchange compartment when waste water within the respective heat exchange compartment reaches an operating level, the coils interconnected in series;

wherein each heat exchange compartment includes a drain outlet, wherein the drain outlet of each heat exchange compartment flows to a common compartment cleaning drain line with an associated valve to control flow or no flow along the common compartment cleaning drain line.

2. The warewash machine of claim 1 wherein the coils are arranged such that a first coil along the fresh water input line is located in a last one of the heat exchange compartments, and a last coil along the fresh water input line is located in a first one of the heat exchange compartments.

3. The warewash machine of claim 1 wherein the heat exchange compartments are arranged as a module with a common lid covering the heat exchange compartments, the common lid movable between closed and open positions, wherein when the valve is in the flow condition and the lid is in the open position, water can be sprayed into the compartments for cleaning the compartments and the cleaning water travels through the drain outlets and along the common compartment cleaning drain line.

4. The warewash machine of claim 1 wherein the heat exchange compartments are located such that head pressure of waste water in the sump drives flow through the compartments.

5. The warewash machine of claim 1 wherein the heat exchange compartments and waste water flow paths between the heat exchange compartments are sized to prevent clogging from any debris in the waste water, and the drain path lacks any filter.

6. The warewash machine of claim 1 wherein the heat exchange compartments are located within a footprint of the warewash machine.

7. The warewash machine of claim 1 wherein the plurality of heat exchange compartments comprises at least three heat exchange compartments.

8. The warewash machine of claim 1 wherein flow adjacent heat exchange compartments are separated by baffle arrangements, the baffle arrangement configured to promote turbulence of waste water flowing through the heat exchange compartments so as to improve heat exchange.

9. The warewash machine of claim 1 further comprising:

a rinse system including a booster heater;

wherein the fresh water input line is operatively connected to deliver fresh water to the booster heater after the fresh water has passed through the waste water heat recovery system.

* * * * *